US007027606B2

(12) United States Patent
D'Agri

(10) Patent No.: US 7,027,606 B2
(45) Date of Patent: Apr. 11, 2006

(54) APPARATUS TO AID REHABILITATION OF HEARING DEFICIENCIES AND HEARING AID CALIBRATION METHOD

(75) Inventor: Pierfrancesco D'Agri, Milan (IT)

(73) Assignee: Amplifon S.p.A., Milan (IT)

( * ) Notice: Subject to any disclaimer, the term of this patent is extended or adjusted under 35 U.S.C. 154(b) by 665 days.

(21) Appl. No.: 10/049,671

(22) PCT Filed: Feb. 13, 2001

(86) PCT No.: PCT/EP01/01578

§ 371 (c)(1),
(2), (4) Date: Feb. 15, 2002

(87) PCT Pub. No.: WO01/97564

PCT Pub. Date: Dec. 20, 2001

(65) Prior Publication Data

US 2002/0136365 A1 Sep. 26, 2002

(30) Foreign Application Priority Data

Jun. 12, 2000 (IT) ..... MI00A1355

(51) Int. Cl.
*H04R 25/00* (2006.01)

(52) U.S. Cl. ..... 381/312; 381/60; 381/314

(58) Field of Classification Search ..... 381/312, 381/314, 60

See application file for complete search history.

(56) References Cited

U.S. PATENT DOCUMENTS

| | | | | |
|---|---|---|---|---|
| 4,759,070 | A | 7/1988 | Voroba et al. | |
| 5,226,086 | A * | 7/1993 | Platt | 381/58 |
| 5,785,661 | A | 7/1998 | Shennib | |
| 5,811,681 | A | 9/1998 | Braun et al. | |
| 6,574,340 | B1 * | 6/2003 | Bindner et al. | 381/60 |
| 2004/0141626 | A1 * | 7/2004 | Basseas | 381/314 |

FOREIGN PATENT DOCUMENTS

| | | | |
|---|---|---|---|
| DE | 196 00 234 | A | 7/1997 |
| FR | 2 664 494 | A | 1/1992 |
| WO | 00 22874 | A | 4/2000 |

* cited by examiner

*Primary Examiner*—Brian Pendleton
(74) *Attorney, Agent, or Firm*—Frank P. Presta; Nixon & Vanderhye, P.C.

(57) ABSTRACT

An apparatus (100) to aid rehabilitation of hearing deficiencies comprising an electronic apparatus (AE) that has a port (101) for connection to a hearing aid adapter (AP) for programming and calibration of auditory prostheses or hearing aids (PA), said electronic apparatus comprising a central processing unit (UE), a user interface (IU) for sending control signals imparted by the user to said central unit (UC), a display unit (UV) and at least one sound module (MS) for viewing and listening to multimedia filmed material, and a memory unit (UM) for storage of data, multimedia files and software programs.

10 Claims, 4 Drawing Sheets

APPARATUS TO AID REHABILITATION OF HEARING DEFICIENCIES AND HEARING AID CALIBRATION METHOD

DESCRIPTION

This application is the US national phase of international application PCT/EP01/01578 filed 13 Feb. 2001, which designated the US.

The present invention refers to an apparatus for implementing a hearing deficiency rehabilitation method, particularly for patients with hearing problems such as hearing loss or deafness. The present invention further refers to a method of calibrating auditory prostheses or hearing aids, implemented by means of said apparatus.

In order to solve problems of impaired hearing, use is generally made of auditory prostheses, commonly known as hearing aids, which are fitted to the ears of the patient (hearing aid fitting). However, a large percentage of patients fitted with hearing aids report dissatisfaction with the results obtained and therefore do not use said hearing aids.

In the past this problem was largely due to a certain limitation of the technologies employed in the manufacture of hearing aids.

Recently digital technologies have been developed in the hearing aid sector that can considerably improve the performance of hearing aids. Hearing aids of the prior art have a chip that can be programmed by means of specific software implemented by the manufacturing companies, so as to set and adjust all hearing aid parameters.

However, some problems still remain, especially in the adjustment and setting of the hearing aid and in the identification of the rehabilitation therapy for the patient.

Technicians (hearing aid fitters) still have insufficient knowledge of last-generation digital hearing aids. In fact hearing aid fitters are not able to perform at their best without the aid of expert systems that guide them in the use of increasingly sophisticated and flexible digital technologies.

The various hearing aid manufacturers have developed software to assist hearing aid fitters, using different approaches that are not standardized. Consequently, each hearing aid fitter experiences difficulty in adjusting prostheses from different manufacturers.

Furthermore, the traditional instruments for diagnosis of hearing loss and checking of the hearing aid, such as audiometric evaluation, have proved increasingly inadequate in providing information on the subjective perception of sounds by the patient and on the patients psycho-auditory status.

Hearing aids are often intended for elderly patients and the present hearing aid fitting methods do not take into consideration the multiple disabilities often present in an elderly patient. The known hearing aid fitting methods consider the patient only as a hearing-impaired individual and not as an elderly person with disabilities, neglecting the aspects of psychology of the elderly and the problems due to ageing of the sensory organs and to precarious spatial orientation, attention and mental alertness.

The object of the present invention is to eliminate said drawbacks by providing an apparatus to aid rehabilitation of hearing loss that is able to provide assistance to the hearing aid fitter in the choice and calibration of the auditory prosthesis.

This object is achieved according to the invention with the characteristics listed in appended independent claim 1.

Another object of the present invention is to provide such a method of calibrating the hearing aid that takes into account the patient's psychological status.

This object is achieved in accordance with the invention with the characteristics listed in appended independent claim 8.

Advantageous embodiments of the invention are apparent from the dependent claims.

The apparatus according to the invention comprises an electronic apparatus provided with a central processing unit, a user interface to send commands to the processing unit, a display unit and sound modules for viewing and listening to multimedia recordings and a memory unit for storage of data and programs.

The electronic apparatus has a first port for connection to a hearing aid adapter for programming of hearing aids and a second port for connection to a telephone line for on-line connection to the Internet or to the central computer of a hearing aid dispensing centre.

A multimedia database is provided in the memory unit comprising a plurality of multimedia recordings representing real-life situations, a patient database comprising patient details and parameters able to define the patient's hearing status, hearing aid programming modules provided by hearing aid manufacturers and an expert system that interfaces between the patient database and the hearing aid programming modules to process the data in the patient database, provide an indication of the choice of hearing aid and calibrate the hearing aid selected.

The method according to the invention provides for a first interaction between patient and hearing aid fitter, in which the real-life situations in which the patient has hearing difficulties are identified, multimedia filmed recordings reproducing the real-life situations in which the patient has hearing difficulties are chosen, questionnaires relating to the recorded material chosen are administered and, on the basis of the patient's replies, parameters indicating the patient's responses to the questionnaires are recorded in the database.

After this first interaction the audiometric evaluation is carried out and the resulting data are stored in the patient's database. On the basis of the data in the patient's database, the expert system suggests to the hearing aid fitter the type of hearing aid that best solves the patient's problems. The hearing aid chosen is placed in the hearing aid adapter and programmed on the basis of the data in the patient's database.

The hearing aid is then handed over to the patient. After a certain period of time there is a second interaction between the patient and the hearing aid fitter in which the patient reports any problems experienced and, with the aid of multimedia recorded material and questionnaires, the patient's database is updated with the problems reported by the patient following fitting of the hearing aid. The hearing aid is then placed in the hearing aid adapter once more and calibrated on the basis of the new data recorded in the patient's database.

The advantages of the apparatus and the method according to the invention are obvious. This interactive multimedia approach allows the patient to be placed in real-life settings. Moreover it involves the patient emotionally and increases his powers of reaction, improves his psychological condition and optimises his cooperative relationship with the therapist.

The apparatus and the method according to the invention allow an optimal choice of hearing aid and furthermore allow rapid, effective calibration of the hearing aid selected, avoiding the long, extenuating tests that the patient would otherwise have had to perform for adjustment of the hearing aid.

Furthermore, the apparatus according to the invention allows the hearing aid fitter to adopt a standardized approach for adjustment of hearing aids, even if hearing aids of different models and from different manufacturers with different programming software are used.

Further characteristics of the invention will be made clearer by the detailed description that follows, referring to a purely exemplary and therefore non-limiting embodiment thereof illustrated in the appended drawings, in which.

Figure 3:
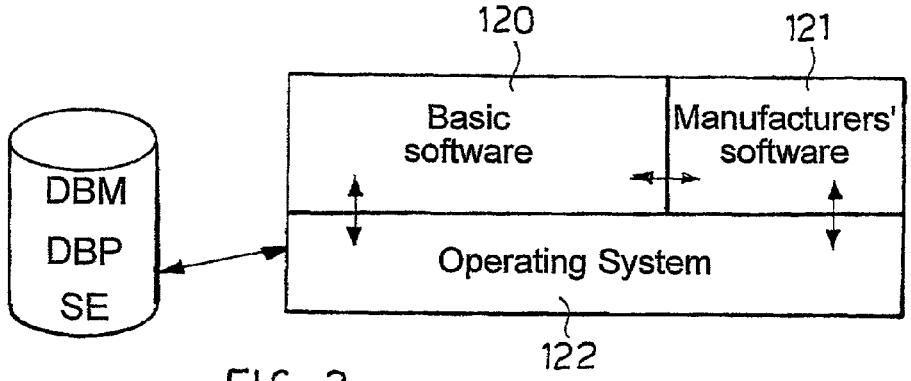
FIG. 3 is a block diagram illustrating schematically the software interface of the apparatus according to the invention.
Figure 3A:
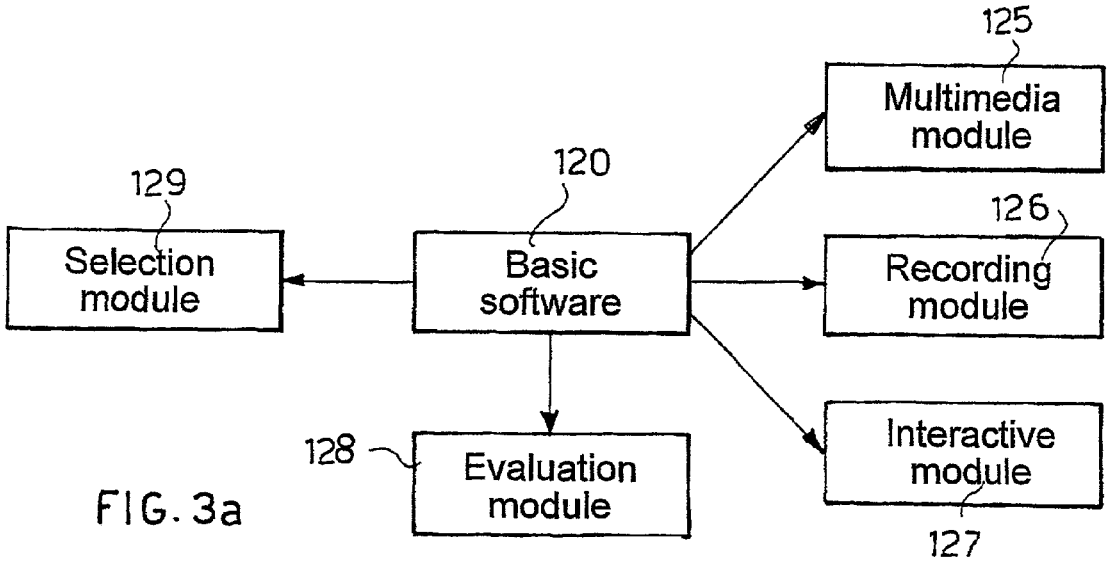
Figure 4:
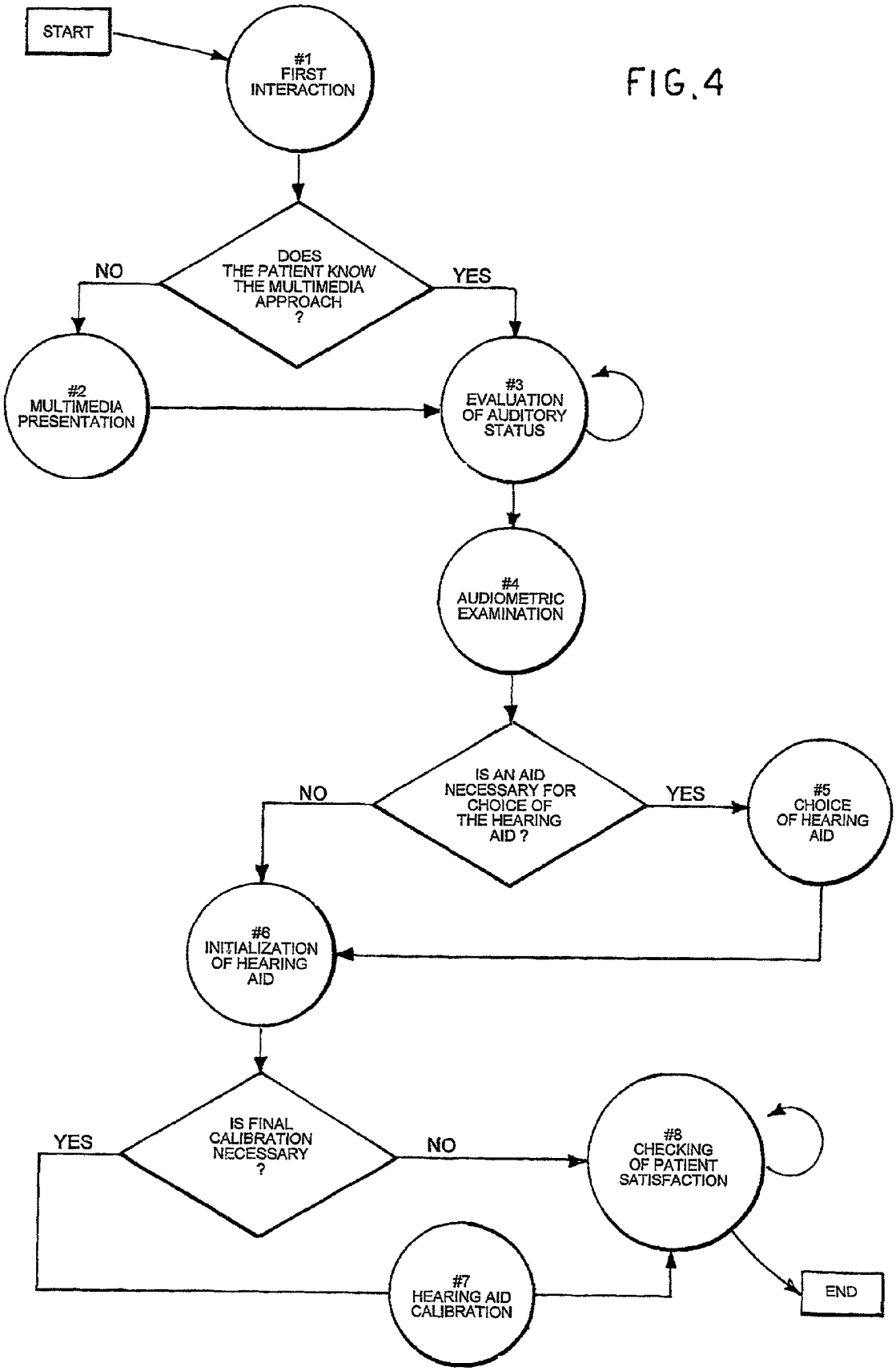
Figure 5:
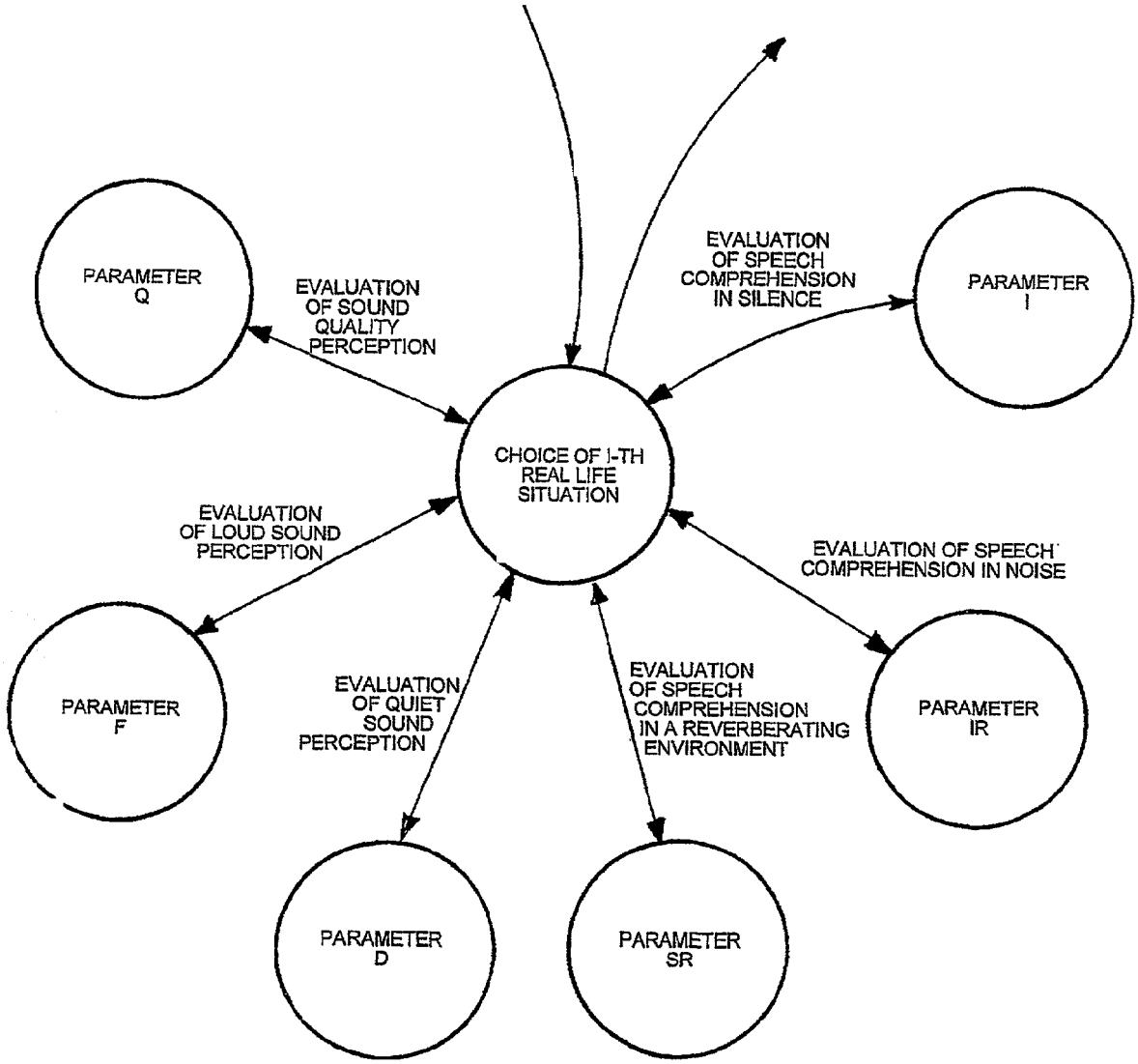

FIG. 3*a* is a block diagram illustrating schematically the software modules provided in the basic software that serves to operate the apparatus according to the invention;

FIG. 4 is a flow chart illustrating the methodology for calibration of a hearing aid according to the invention;

FIG. 5 is a flow chart illustrating in greater detail phases 3 and 8 of the diagram in FIG. 4.

Figure 1:
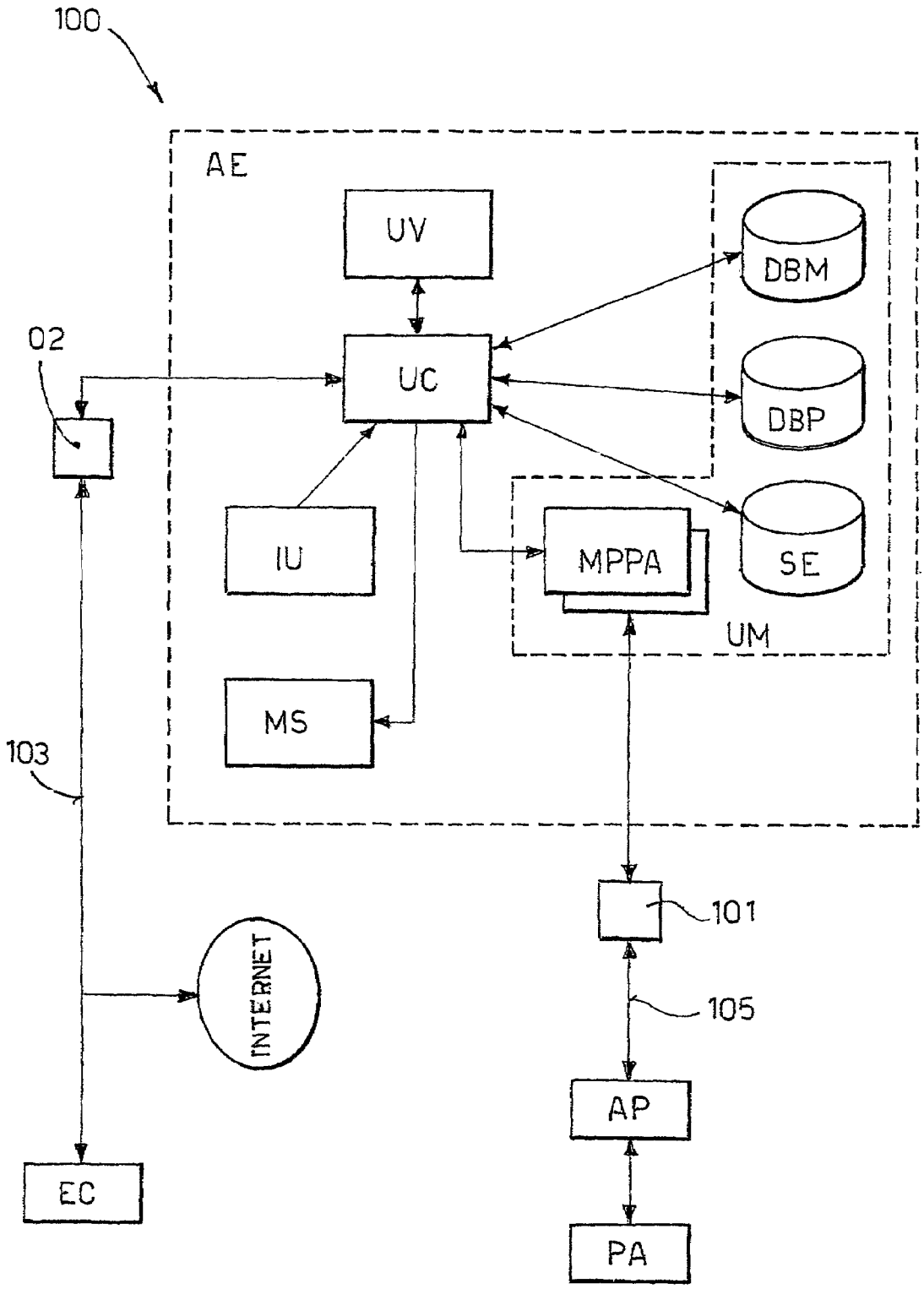
FIG. 1 is a block diagram illustrating in a general manner the apparatus that implements the method according to the invention.

The block diagram of FIG. 1 generically illustrates the apparatus to aid rehabilitation of hearing impairments in accordance with the invention, which is indicated as a whole with reference numeral 100.

The apparatus 100 comprises an electronic apparatus AE that provides a first data input/output port 101 for connection to a hearing aid adapter AP and a second data input/output port 102 for connection to a telephone line 103.

The hearing aid adapter AP is a per se known device that is connected to a hearing aid or auditory prosthesis PA for programming, adjustment and calibration thereof. The hearing aid adapter AP can be connected to the electronic apparatus AE by means of a serial line 105.

The apparatus 100 can be directly connected via the telephone line 103 to a central computer EC situated at a hearing aid dispensing centre or the like and can also be connected to the Internet. In this manner operation of the apparatus 100 can be governed remotely via the Internet or the dedicated telephone line.

The electronic apparatus AE has a central unit UC comprising a processing unit proper that manages operation of the electronic apparatus AE.

The apparatus 100 is destined to be used by hearing aid fitters and patients, and therefore it has a user interface IU to interact with the operators. The user interface IU can be a keyboard, a pushbutton pad, a mouse or any other device that allows control signals to be sent to the central unit UC.

The apparatus 100 must provide the possibility of displaying information and multimedia recorded material. For this purpose the central unit UC is connected to the display unit UV and to a sound module MS. The display unit can be any liquid crystal display or a screen with a cathode ray tube. The sound module MS can be any type of broadcaster or loudspeaker. Obviously a video board will be provided for interfacing between the central unit UC and the video unit UV and an audio board for interfacing between the central unit UC and the sound module MS.

The electronic apparatus AE further comprises a memory unit UM that can be, for example, a hard disk.

A multimedia database DBM comprising a plurality of multimedia recordings reproducing real-life scenarios and situations and a multimedia recording illustrating the multimedia approach according to the invention used for rehabilitation of the patient's hearing impairment are stored in the memory unit UM. The multimedia database DBM can already be resident in the memory unit UM or can be created and updated by downloading files representing said multimedia recordings via the telephone line 103 or from a driver (not shown) or reader of the storage media in which said files representing the multimedia recordings are stored.

A patient database DBP is stored in the memory unit UM and is intended to contain all the data concerning a patient, that is to say the patient's personal data and parameters that make up the evaluation of the patient's hearing status before, during and after fitting of the hearing aid. The data in the patient's database DBP can be loaded directly by means of the user interface IU, or can be downloaded from the central computer EC via the telephone line 103. Moreover the data in the patient database DBP can be sent via the telephone line 103 to the central computer EC situated in a hearing aid dispensing centre.

Hearing aid programming modules MPPA provided by the hearing aid manufacturing companies are also stored in the memory unit UM. The hearing aid programming modules MPPA are in communication, by means of a suitable interface, with the hearing aid adapter AP for exchange of data therewith, so as to be able to program, adjust and calibrate the selected hearing aid PA.

Lastly, an expert system SE that comprises a plurality of software programs that allow operation of the apparatus 100 is provided in the memory unit UM. The expert system SE interacts with the central unit UC to process the data contained in the patient database DBP in order to provide indications on the choice of hearing aid PA best suited to the patient's requirements. Moreover, the expert system SE interfaces with the hearing aid programming modules MPPA to allow calibration of the selected hearing aid PA on the basis of the data processed. The expert system SE can be constantly updated via the telephone line 103.

Figure 2:
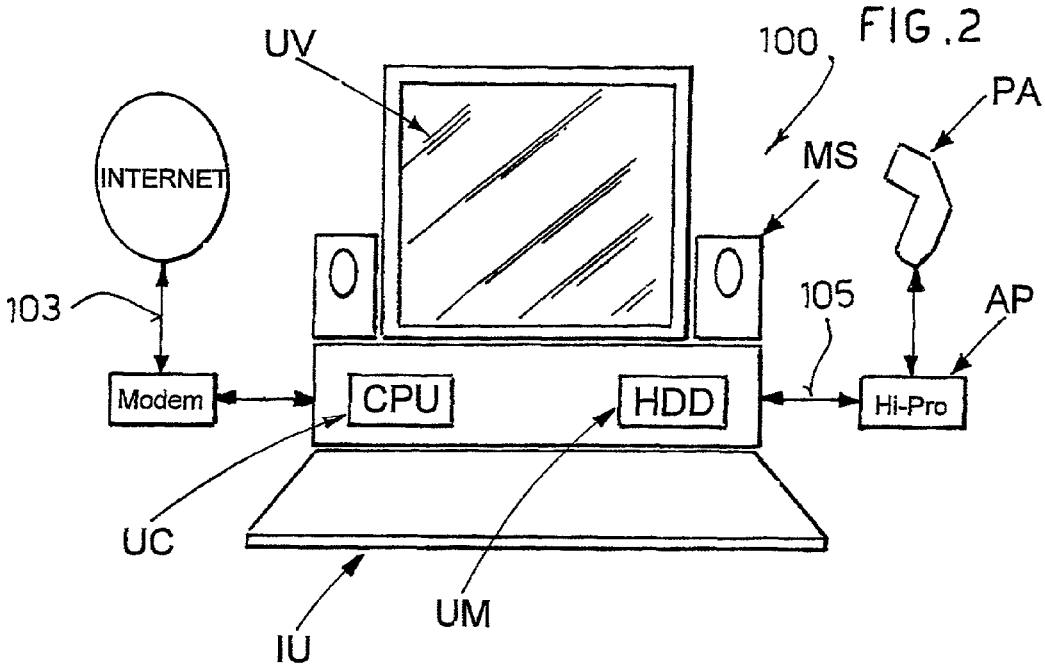
FIG. 2 is a block diagram illustrating schematically a preferred embodiment of the apparatus according to the invention.

FIG. 2 shows a possible implementation of the apparatus 100 according to the invention. The apparatus 100 comprises a personal computer of the multimedia type in which the central unit UC is a CPU, the video unit UV is a screen, the sound modules MS are loud speakers, the user interface IU is a keyboard and the memory unit UE is a hard disk (HDD).

The personal computer is connected, by means of a serial line 105, to a hearing aid programmer (Hi-Pro) that represents the hearing aid adapter AP, and by means of a modem to a telephone line for connection to the Internet.

FIG. 3 shows an interaction between the software present in the personal computer 100. Essentially, basic software 120 specially developed for operation of the apparatus according to the invention and software 121 supplied by the hearing aid manufacturers that comprises the various hearing aid programming modules MPPA are installed on the hard disk of the computer.

The basic software 120 and he hearing aid manufacturers' software 121 are interfaced with the operating system 122 of the computer. The operating system 122 is in turn interfaced with the expert system SE, with the patient database DBP and the multimedia database DBM.

As shown in FIG. 3*a*, the basic software 120 comprises various software modules that perform dedicated functions.

A multimedia module 125 serves to select and play the multimedia recordings present in the multimedia database DBM and ask the patient questions and administer questionnaires aimed at determining the hearing impairment.

A recording module 125 serves to record the results of the evaluations carried out on the patient. Said module is also responsible for comparing the results of successive evaluations and printing out said results. Said module is also responsible for sending said data, via the telephone line, to a central computer EC situated in a hearing aid dispensing centre.

An interface module 127 is responsible for interfacing the basic software 120 with the hearing aid manufacturers' software 121 to allow programming and calibration of the selected hearing aid.

An evaluation module 128 is responsible for evaluating the patient's response after each calibration of the hearing aid. This evaluation is performed by running the multimedia recordings made by the multimedia module 125 and on the basis of the responses given by the patient and recorded on the recording module 126. In this manner the evaluation module 128 can evaluate on an objective basis:

speech comprehension and the patient's reaction to sound stimuli; and the patient's response after each calibration of the hearing aid.

According to the results of an audiometric evaluation, a selection module 129 suggests to the hearing aid fitter the most suitable hearing aid for the patient concerned.

With reference to FIGS. 4 and 5 the method for calibrating a hearing aid according to the invention is described. Said method is based on the interaction between the patient and the hearing aid fitter, which develops along various steps, whose course is illustrated in the flow chart of FIG. 4.

Step 1. First interaction between patient and hearing aid fitter.

During this stage there is a first interview between the hearing aid fitter and a new patient or a patient with a hearing aid already fitted. The hearing aid fitter listens to the patient's needs and identifies the most important real-life situations in which the patient suffers from lack of communication. At this stage it is important to put the patient at ease, encouraging him to talk about his life style in order to categorize the patient from an auditory and psychological viewpoint. Once the hearing aid fitter has categorized the patient from an auditory and psychological viewpoint, he proceeds to the next step.

Step 2. Presenting the patient with the approach that will be followed to remedy his hearing impairment.

By means of the apparatus 100, the hearing aid fitter selects from the multimedia database DBM a multimedia recording that illustrates for the patient the integrated psycho-auditory approach to hearing aid fitting, explaining how the examination will take place. Then, by means of the display unit UV the patient is shown the selected filmed recording.

This multimedia filmed recording illustrates the activities that will be carried out by the hearing aid fitter to solve the patient's problem, which is not only a hearing problem but also a problem of communication and integration in general. This stage serves to reassure the patient by explaining what he will undergo and during this stage the patient is also introduced to the multimedia tool. It is obvious that stage 2 is optional and entirely superfluous for patients who are already familiar with this type of approach.

Stage 3. Evaluation of the patient's auditory status in the life situations that are important to him.

During this stage the patient, assisted by the hearing aid fitter, chooses from the multimedia database DBM some multimedia filmed recordings that reproduce the real-life situations which are most important to him. Each recording features particular psycho-auditory aspects, such as speech comprehension in a silent and in a noisy environment, quality of sounds, emotional reaction, aptitude tests, etc.

The filmed recordings are displayed via the display unit UV and at the end of each one the patient is administered a multiple response questionnaire concerning the auditory features heard in the recording. On the basis of what he has succeeded in hearing during the filmed recording, the patient can select one of the possible responses to the questionnaire.

As shown in FIG. 5, after the choice of the I-th real-life situation has been made, six different evaluations of auditory characteristics are made, in which each auditory characteristic is identified by a parameter. In particular the following are taken into consideration: speech comprehension in silence (I), speech comprehension in noise (IR), speech comprehension in reverberating environments (SR), patient's reaction to quiet sounds (D), patient's reaction to loud sounds (F) and patient's reaction to the quality of sounds (Q). In addition some parameters of attention and emotive reaction are evaluated. On the basis of the patient's responses a weight is given to the parameters that distinguish the auditory characteristics considered.

The data relating to said parameters are stored in the patient's database DBP. A printout is available on request in which said information on the parameters of the auditory characteristics are represented graphically.

Step 4. Audiometric evaluation.

During this stage an audiometric evaluation proper is carried out by means of per se known aids and instruments not described herein. The audiometric evaluation serves to objectively define the patient's hearing loss and provides objective data on his hearing status.

Step 5. Choice of hearing aid.

By means of the apparatus 100 according to the invention, the results of the audiometric evaluation are entered into the patient's database DBP. Then the data concerning the audiometric evaluation and the parameters of the patient's auditory characteristics are processed by the expert system SE provided in the apparatus according to the invention. The expert system SE, on the basis of the information obtained, provides the hearing aid fitter with the data on which to choose the hearing aid PA best suited to the specific patient. The expert system SE indicates to the hearing fitter the manufacturer and model of the hearing aid best suited to solve the patient's problems.

Step 6. Initialization of the hearing aid.

The hearing aid PA chosen by the expert system is placed in the hearing aid adapter AP connected to the apparatus 100 according to the invention, and is programmed for a first use, on the basis of the results produced by the expert system with the data in the patient database DBP. Programming of the hearing aid AP is done using the manufacturers' software MPPA, which is resident in the memory unit UA of the apparatus 100 according to the invention.

Step 7. Calibration of the hearing aid.

After having used the hearing aid PA for a certain period of time, for example two weeks, the patient contacts the hearing aid dispensing centre to report any problems experienced. In fact, it often happens that the patient experiences problems and a new calibration of the hearing aid is therefore required.

Once the patient's problems have been identified, multimedia filmed recordings that reflect the real-life situations in which the patient has had communication problems are played again by means of the apparatus 100 according to the invention. The relevant questionnaires are then administered and the patient's database DBP is updated on the basis of the latest responses provided. At this point the expert system SE processes the available data once more and interfaces with the specific manufacturer's software MPPA for the selected hearing aid PA and launches a new calibration of the hearing aid. All this takes place in a standardized manner, irrespective of the hearing aid manufacturer or model.

After a second calibration has been carried out, the effects are verified in real time. To do this a multimedia recording which reconstructs sounds, images and situations in which the patient has had problems is played by the apparatus 100. If the second calibration has been successful, the patient should no longer experience problems in the scenarios shown by the recording. It is obvious that this practice drastically reduces the time taken to achieve patient satisfaction. The frequent contacts between the patient and the hearing aid dispensing centre, which can cause frustration, mistrust and discouragement in the patient, are thus avoided.

Step 8. Checking the patient's satisfaction and his improvement in communication.

Once all the calibration operations have been carried out on the hearing aid PA, an evaluation of the end benefit can be performed. The multimedia situations used in step 3 for the initial evaluation are repeated by means of the apparatus 100. The new responses to the same questions allow the benefits following fitting of the hearing aid to be evaluated. During this stage is possible to print a hard copy report that graphically illustrates the benefits to the patient with respect to the previous situation.

The centres where the patient goes to interact with the hearing aid fitter can be provided with the apparatus according to the invention.

Hearing aid fitters can also be provided with the apparatus according to the invention and if this is a portable apparatus, the hearing aid fitter can take it to his office or directly to the patient's home.

The apparatus according to the invention can also be given directly to patients. In this case the patient's apparatus is connected via a telephone line to another similar apparatus with which the hearing aid fitter is provided. In this manner the hearing aid fitter and the patient can communicate with one another by remote access.

Numerous variations and modifications of detail within the reach of a person skilled in the art can be made to the present embodiment of the invention whilst still remaining within the scope of the invention as set forth in the appended claims.

The invention claimed is:

1. An apparatus (100) to aid rehabilitation of hearing deficiencies comprising an electronic apparatus (AE) which has a port (101) for connection to a hearing aid adapter (AP) for programming and calibration of hearing aids or auditory prostheses (PA), said electronic apparatus comprising:

a central processing unit (UC), a user interface (IU)) for sending control signals imparted by the user to said central unit (UC), a display unit (UV) and at least one sound module (MS) respectively for displaying and listening to multimedia filmed recordings, and a memory unit (UM) for storage of data, multimedia files and software programs;

said memory unit comprising:

a multimedia database (DBM) comprising a plurality of multimedia filmed recordings depicting real-life situations that can be reproduced by means of the display unit (UV) and the sound modules (MS);

a patient database (DBP) comprising data representing the patient's personal data and auditory status, at least one hearing aid programming module (MPPA) provided by the hearing aid manufacturers, and an expert system (SE) able to process the data representing the patient's auditory status contained in the patient database (DBP) in order to suggest the choice of a hearing aid (PA) and to programme and calibrate a hearing aid (PA).

2. An apparatus according to claim 1, characterized in that it comprises a port (102) for connection to a telephone line (103).

3. An apparatus according to claim 2, characterized in that by means of said telephone line (103) a direct link is provided with at least one central unit (EC) situated in at least one hearing aid dispensing centre and with the Internet, so that operation of the system of the apparatus (100) can be governed remotely via the Internet or a dedicated telephone line.

4. An apparatus according to claim 1, characterized in that said multimedia database (DBM) further comprises a multimedia filmed recording representing the multimedia approach it is intended to follow in rehabilitating the patients hearing deficiency.

5. An apparatus according to claim 1, characterized in that said memory unit (UM) is provided with basic software (120) implemented to regulate operation of the apparatus (100) and hearing aid manufacturers' software (121) comprising the hearing aid programming modules (MPPA), said basic software (120) and said hearing aid manufacturers' software (121) being interfaced with each other and with an operating system (122) of the apparatus (100).

6. An apparatus according to claim 5, characterized in that said basic software (120) comprises:

a multimedia module (125) to select and play the multimedia recordings present in the multimedia database (DBM), a recording module (126) to record the data representing the patient's auditory status in the patient database (DBP), an interface module (127) to interface the basic software (120) with the hearing aid manufacturers' software (121), an evaluation module (128) to evaluate on an objective basis the patient's speech comprehension, reaction to auditory stimuli and response after each calibration of the hearing aid, and a selection module (129) that, on the basis of the results of the audiometric evaluation, suggests to the hearing aid fitter the hearing aid best suited to solve the patient's problems.

7. A method for calibration of a hearing aid or auditory prosthesis (PA) comprising the following steps:

first interaction between the hearing aid fitter and the patient to study the patient from an auditory and psychological viewpoint, in which, with the aid of multimedia recordings and questionnaires, data depicting the patient's subjective hearing status are obtained, audiometric examination to obtain data depicting the patent's objective hearing status, choice of hearing aid on the basis of said data obtained in the first interaction and from the audiometric evaluation, programming of the hearing aid on the basis of said data obtained from the first interaction and the audiometric examination, said first interaction step with the patient further comprising viewing by the patient of a multimedia recording which illustrates the multimedia approach it is intended to follow for rehabilitation of the patient's hearing impairment.

8. A method according to claim 7, characterized in that it further comprises a second interaction between the patient and the hearing aid fitter in which the patient defines the problems experienced following fitting of the hearing aid and, with the aid of multimedia recordings and questionnaires reflecting the real-life situations in which the patient has had problems, new subjective data are provided on the patient's hearing status which are used for new programming and calibration of the hearing aid selected for the patient.

9. A method according to claim 7, characterized in that said data defining the patient's subjective hearing status are obtained on the basis of parameters defining various auditory characteristics such as speech comprehension in silence (I), speech comprehension in noise (IR), speech comprehension in reverberating environments (SR), patient's reaction to quiet noises (D), patient's reaction to loud noises (F), and patient's reaction to the quality of sounds (Q).

10. A method according to claim 7, characterized in that said first interaction between the patient and the hearing aid fitter further comprises a psychological evaluation of the patient to check his response and his cooperation with the hearing aid fitter's examination.

* * * * *